US009656138B1

(12) United States Patent
Chalifoux

(10) Patent No.: US 9,656,138 B1
(45) Date of Patent: May 23, 2017

(54) PUSH COMPRESSION INTERCHANGEABLE GOLF GRIP

(71) Applicant: Paul Chalifoux, Naples, FL (US)

(72) Inventor: Paul Chalifoux, Naples, FL (US)

( * ) Notice: Subject to any disclaimer, the term of this patent is extended or adjusted under 35 U.S.C. 154(b) by 0 days.

(21) Appl. No.: 15/176,200

(22) Filed: Jun. 8, 2016

Related U.S. Application Data

(63) Continuation-in-part of application No. 15/138,162, filed on Apr. 25, 2016, now Pat. No. 9,452,333.

(51) Int. Cl.

| | |
|---|---|
| ***A63B 53/14*** | (2015.01) |
| ***A63B 60/16*** | (2015.01) |
| *A63B 60/14* | (2015.01) |
| *A63B 60/22* | (2015.01) |

(52) U.S. Cl.
CPC ..... *A63B 60/16* (2015.10); *A63B 53/14* (2013.01); *A63B 60/14* (2015.10); *A63B 60/22* (2015.10)

(58) Field of Classification Search
CPC ..... A63B 60/16; A63B 60/14; A63B 60/22; A63B 53/14
See application file for complete search history.

(56) References Cited

U.S. PATENT DOCUMENTS

| | | | | | |
|---|---|---|---|---|---|
| 3,112,547 | A * | 12/1963 | Poe | F16B 19/1081 | 411/360 |
| 5,356,252 | A * | 10/1994 | Whistler, III | F16B 13/06 | 411/45 |
| 5,716,289 | A * | 2/1998 | Okoneski | A63B 60/24 | 473/297 |
| 6,302,614 | B1 * | 10/2001 | Tseng | F16B 7/1463 | 248/125.8 |
| 6,324,731 | B1 * | 12/2001 | Pliml, Jr. | F16B 19/1081 | 24/297 |
| 7,582,023 | B2 * | 9/2009 | Hung | A63B 53/14 | 411/55 |
| 7,806,600 | B2 * | 10/2010 | Marrs | G02B 6/3802 | 385/55 |
| 8,337,322 | B2 * | 12/2012 | Harper | A63B 57/50 | 473/286 |
| 8,678,944 | B2 * | 3/2014 | Wall, Jr. | A63B 53/10 | 403/109.3 |
| 8,758,155 | B1 * | 6/2014 | Demkowski | A63B 53/12 | 473/296 |
| 9,065,307 | B2 * | 6/2015 | Sajdowitz | H02K 9/06 | |
| 2012/0142444 | A1 * | 6/2012 | Chol | A63B 53/10 | 473/296 |
| 2013/0344977 | A1 * | 12/2013 | Chalifoux | A63B 53/16 | 473/299 |
| 2015/0231462 | A1 * | 8/2015 | Chapin | A63B 60/34 | 473/300 |

* cited by examiner

*Primary Examiner* — Stephen Blau

(57) ABSTRACT

An interchangeable golf grip is secured with a snap compression unit that enters into a golf club shaft.

11 Claims, 10 Drawing Sheets

PUSH COMPRESSION INTERCHANGEABLE GOLF GRIP

CROSS-REFERENCE TO RELATED APPLICATION

This application is a continuation-in-part of U.S. patent application Ser. No. 15/138,162, filed 25 Apr. 2016, now U.S. Pat. No. 9,452,333.

BACKGROUND

Field of the Invention

The present invention refers to a method allowing quick placement and quick removal of golf grips onto a golf club. Quick change of golf grips allow golfers to try different golf grips on golf clubs before purchasing one. Quick change of golf grips further allows easy replacement of worn golf grips. Present methods to change a golf grip requires cutting off a golf grip, removing adhesive tape, reapplying adhesive tape, applying a slippery agent such as acetone and sliding on a new grip.

The present invention further allows perfect placement of a golf grip. If a golf grip is placed onto a golf club shaft and it is discovered to be misaligned, it is easily repositioned. It is further designed to allow different placement that makes a golf club longer or shorter.

Description of Concurrent Art

Golf grips aid a golfer in holding a golf club. Golf clubs include drivers, woods, irons, wedges and putters. Present grips come in a wide variety of sizes, shapes, colors, materials, textures, tapers, and the like. It is difficult to evaluate which grip fits a golfer's hand best and works best as a golfer cannot try them on a golf club and strike balls. Presently, a golfer evaluates how a grip feels in their hand with no golf club attached to the grip. If a golfer likes the feel of a grip in their hand, the grip is permanently attached to a club. If grips are attached to a golfer's clubs and they do not like them, it is an expensive and time consuming process to replace them.

Present technology to change a golf grip requires cutting off a golf grip, removing adhesive tape, reapplying adhesive tape, applying a slippery agent such as acetone and sliding on a new grip. The process is complex enough that most golfers do not change their own grips but have professionals do it for them. Professional regripping is expensive and time consuming. The process makes it difficult for a golfer to effectively evaluate grips.

It would be advantageous to have grips that simply slide onto a shaft and are secured with a simple turn of a component. It would be advantageous to have a technique that allows grips to be placed and removed in seconds for better selection at point of purchase and ease of replacement. It would be further advantageous for a golfer to be able to adjust a grips position as required to perfect alignment with the club head or adjust a club length.

The United States Golf Association, referred to as the USGA, has specific rules for golf equipment that a golfer must follow for use in tournaments and professional play. USGA rules define specifications for grip shape, size, position and the like. One of the USGA rules is that a golf club and its components cannot easily be adjusted by a golfer during play. To change or adjust components on golf equipment, a special tool is required to adhere to USGA rules. The present invention has unique features created specifically to follow these rules.

SUMMARY OF THE INVENTION

The instant apparatus and system, as illustrated herein, is clearly not anticipated, rendered obvious, or even present in any of the prior art mechanisms, either alone or in any combination thereof. A versatile system, method and series of apparatuses are revealed for creating and utilizing compression techniques to secure golf grips and make them easily interchangeable.

The proposed golf grip includes a compression unit which enters into a golf club shaft. A golf grip is placed onto a golf club shaft such that a compression unit enters the shaft. When the compression unit is engaged, the grip is secured.

In the preferred embodiment, golf grips consist of a core as two rods extending through the length of a grip which is surrounded by rubber, plastic or like materials to form a grip. The core is constructed of plastic, metal, rubber, ceramic, wood or any other common materials or combinations or layers of materials. Outside materials form the individual shape, texture, color and the like.

In an alternative embodiment, golf grips consist of a full central core which is surrounded by rubber, plastic or like materials to form a grip. The core is constructed of plastic, metal, rubber, ceramic, wood or any other common materials or combinations of materials. Outside materials form the individual shape, texture, color and the like.

The grip fits over a golf club shaft. In the preferred embodiment, it expands over a shaft as it slides down to a final position. The grip may be passive but in the preferred embodiment, it maintains constant compression onto a golf shaft. The resulting friction helps stabilize a grip. The compression is controlled so resistance vs force applied allow it to slide onto a shaft. A rubber grip cannot slide onto a golf shaft if the diameter is too small and tight.

The core is constructed inside a golf grip and is placed directly onto a golf shaft. Alternatively, core material is constructed inside a golf grip such that the core material does not touch the shaft. The core may be a complete or partial cylinder as would occur with reinforcing rods. The core provides reinforcement to minimize bending and movement of grip material.

Golf club shafts vary in diameter at the butt end. The butt end is 0.560, 0.580, 0.600, or 620 inches. The diameter of a golf shaft decreases progressing down toward the club head. In the preferred embodiment, the core expands to fit onto a shaft by material elasticity and or by core structural design.

In an alternative design, an internal support is placed within grip material and not exposed to the outside. It provides stiffness and resistance to movement. A compression unit inside a golf shaft transfers support to a grip through the core. A compression unit is joined to the core. The compression unit is joined to a core or alternatively to the grip material directly.

A golf grip expands during placement and remains expanded when fully placed. The inside of the golf grip is smaller than the outside diameter of a golf club shaft. The resulting compression provides resistance to movement. Friction onto a golf shaft resulting from grip compression provides resistance to movement. The golf grip fits securely with compression however; it is not secure enough that movement would not occur during use. The grip is fixed securely with a compression unit. Resistance from core compression is weak enough to allow grip placement. A grip is not secure enough to play golf without securing a compression unit. In one alternative, a weak restickable adhesive or rubber like material lines the inside of a core. In one alternative, weak restickable adhesive or rubber like material lines the inside of a grip.

To augment grip stability, a compression component extends into a golf club shaft. The compression component is joined to the grip core or to grip material. The compression component and grip inside surface provide adequate force to secure and stabilize a grip to a golf club.

The compression component includes a central hole that accepts a key component. The key component is pressed into the compression component resulting in expansion. The key component has a nonlinear lower portion. The shape may be round, square, triangular, oval, rectangular, hexagonal, heptagonal, or any common geometric shape.

In the preferred embodiment for USGA approval, the central key component includes a lower nonlinear section and is placed inside the compression component. The compression component has a split lower section resulting in leg like extensions. There may be two or as many as one hundred leg extensions. Pressing a central key component into the compression component engages areas of decreased diameter. When the areas of decreased diameter are engaged the compression component legs move outward. Expansion of the compression unit results in compression onto the inside wall of a golf club shaft. The compression unit is joined to the golf grip resulting in a stabile golf grip. The key component and outer compression unit are constructed of common materials such as plastic, nylon, metal, rubber, ceramic, cloth, or other common materials. Layers of differing materials or layers of the same materials may be used to for each component.

In the preferred design, internal ramps force the key component to be in one of two positions. The key is either in an inactive or active compression position. The key cannot be at any position between active and inactive as forces do not allow enough stability to stay in that position. Ramps force the position to be in or not in compression. In the inactive position, the inner diameter of the compression unit is the same as the diameter of the key component. In the active position, the inner diameter of the compression unit is less than the diameter of the key component.

Ramps inside the compression unit force the key to slide into one position or the other. If the key goes half way up a ramp, forces return it to the inactive position. The key will be forced to the active position once it has progressed up an inactive ramp, over the hump and down a ramp to the active side. Effectively, the key snaps from one position to the other when engaging the ramps. In the preferred embodiment designed for USGA approval, the inner central key component is either in active or inactive compression.

The central key component is circular, oval, square, triangular, or like shapes in cross section to provide a snap like movement from one position to the other. The key varies in shape from top to bottom. The out of round portion may be at the top or the bottom of the key. Central portions of the key are usually round to allow rotation when desired for removal.

In one alternative, the key is placed and cannot be removed as flat surfaces contact flat surfaces. A special tool such as a hex Allen wrench engages the top of the key component. It provides a means to engage the central key component and transfer force for rotational movement. Alternatively, an instrument is design such that it can grab by inside or outside contact the key component to pull it for removal.

As an example of use, a golfer wants to try different grips on a putter to determine which grip is most comfortable and allows them to golf best. A grip is placed onto a putter shaft by pressing it downward. The grip is secure enough from core compression to test putt without tightening the compression unit. The grip is removed and the next one placed. Several grips are quickly changed and tried on the putter to determine the best one. Once a decision has been reached which one they would like to use, the compression unit is secured. Alternatively, a golfer may cement or adhere with adhesive tape the grip, though this is not preferred.

The present design further allows a golfer to position the grip fully or partially onto a golf club shaft effectively changing golf club length. The internal compression unit must be sufficiently in a golf club shaft to secure it. The present design allows as much as several inches change in putter length.

A golf club shaft diameter decreases as one moves down the shaft. The end of a golf grip has a matching smaller diameter such that it will be pressing onto a shaft when fully seated. The grip core is split into sections with vertical slots at the end to allow expansion. When the end of a golf grip is placed onto a golf club shaft, it expands. The end of the core may have one or many splits for expansion. In the preferred embodiment, the end remains in compression for greater stability when fully seated.

In the preferred embodiment, the grip is rubber with reinforcing rods running through the material length wise. The rubber maintains enough flexibility to adapt to various shaft diameters throughout its length.

In one alternative, a core inside a grip has a long split starting from the top and extends part way down the core. Another split starts at the opposite end of the core in a different plane and goes part way up and passes the opposite split. This offset split construction minimizes movement and rotation while allowing expansion and maximum compression. Splits do not need to go to the end of the core to allow grip expansion. A split or slot may be an intra-core construction.

A grip component is molded directly onto an inner core or manufactured separately and secured with adhesives, friction, snaps, Velcro, morses taper or like methods. Components can be constructed with various coatings or layers such as rubber.

The USGA, United States Golf Association, rules state that a golfer cannot easily adjust components on golf clubs during play. Present compression units revealed in previous patents provide controlled compression with threaded screws. A compression unit using screws can be tightened part way and create enough force to use the golf club but be adjustable by hand pressure. For example, a compression unit is tightened part way on a putter. It is turned 10 degrees. There is enough compression for a golfer to putt however; if enough hand force is applied to the grip, it can move and be adjusted. This is in violation of USGA rules. For this reason, the preferred embodiment of this invention uses a snap compression unit that cannot be tightened part way.

A key component is pressed into a compression unit resulting in the expansion of the compression component inside a golf shaft. A snap component which is part of the compression unit, engages the key component. A ramp formed as a projection acts as a snap so when the inner component is positioned, it cannot stay on the ramped areas. It must go past the projection to engage. It cannot stop part way and thus will be acceptable to USGA requirements. As alternative, certain shapes such as a rounded rectangle shape simulates the ramp action though a projection is not seen.

The push key component is alternatively designed to rotate and disengage compression. At ninety degrees, a flat area with a diameter that matches the inner diameter of the outer compression component is used.

In an alternative form, the compression unit is a solid lower structure with no slots for expansion. A central hole allows a key to be positioned. The lower segment of the compression unit or the whole compression unit is an elastic material that expands from insertion of a larger diameter key.

The foregoing has outlined the more pertinent and important features of the present invention in order that the detailed description of the invention that follows may be better understood, and the present contributions to the art may be more fully appreciated. It is of course not possible to describe every conceivable combination of components and/or methodologies, but one of ordinary skill in the art may recognize that many further combinations or permutations are possible. Accordingly, the novel architecture described below is intended to embrace all such alterations, modifications, and variations that fall within the spirit and scope of the appended claims.

There has thus been outlined, rather broadly, the more important features of the versatile push*compression interchangeable golf grip system and series of accompanying systems and apparatuses and embodiments in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

To the accomplishment of the foregoing and related ends, certain illustrative aspects are described herein in connection with the following description and the annexed drawings. These aspects are indicative of the various ways in which the principles disclosed herein can be practice and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

The advantages of the present apparatus will be apparent from the following detailed description of exemplary embodiments thereof, which description should be considered in conjunction with the accompanying drawings, in which:

Figure 1:
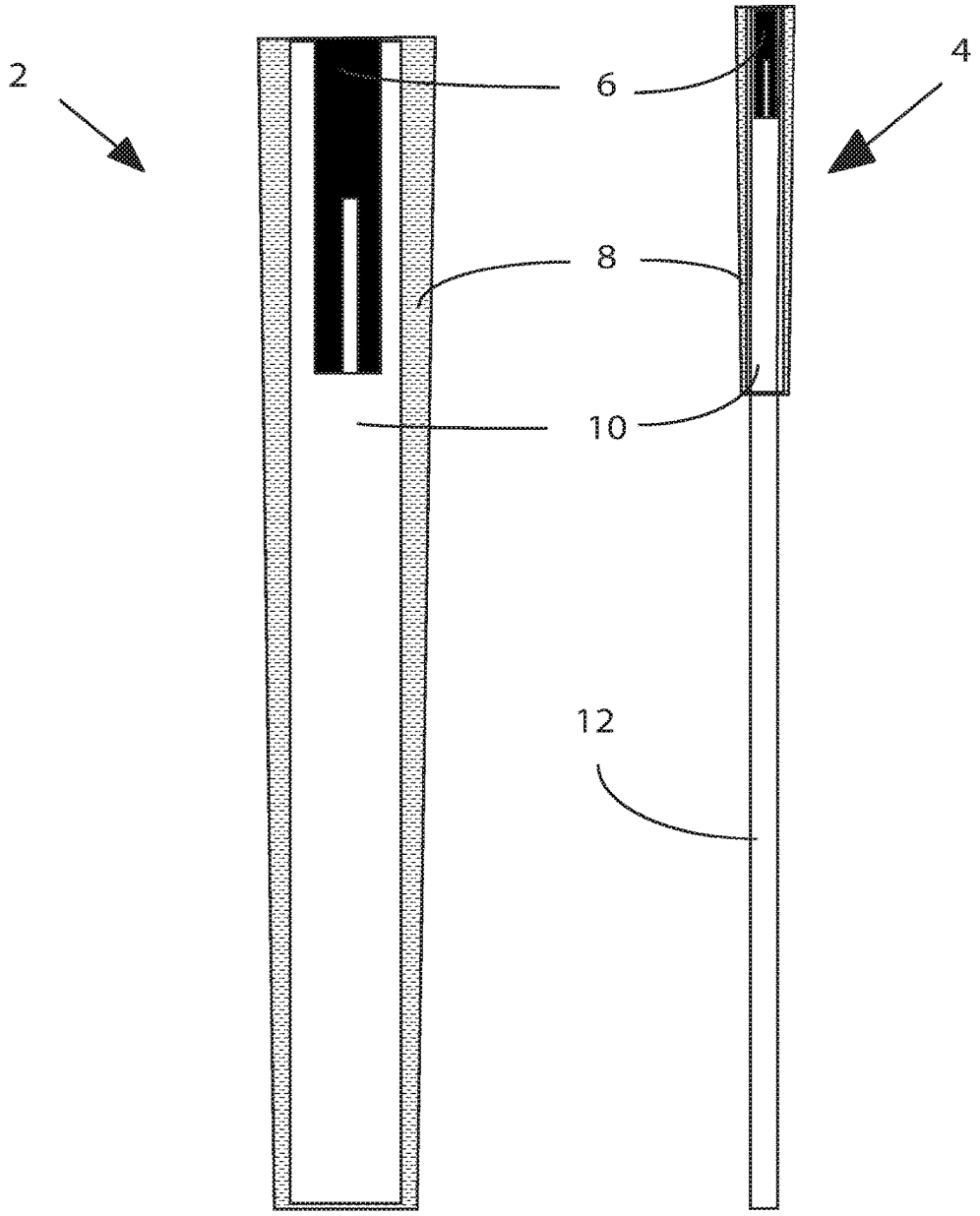

Having thus described the system in general terms, reference will now be made to the accompanying drawings, which are not necessarily drawn to scale, and wherein:

FIG. 1 illustrates a cross section view of the golf grip of this invention.

Figure 2:
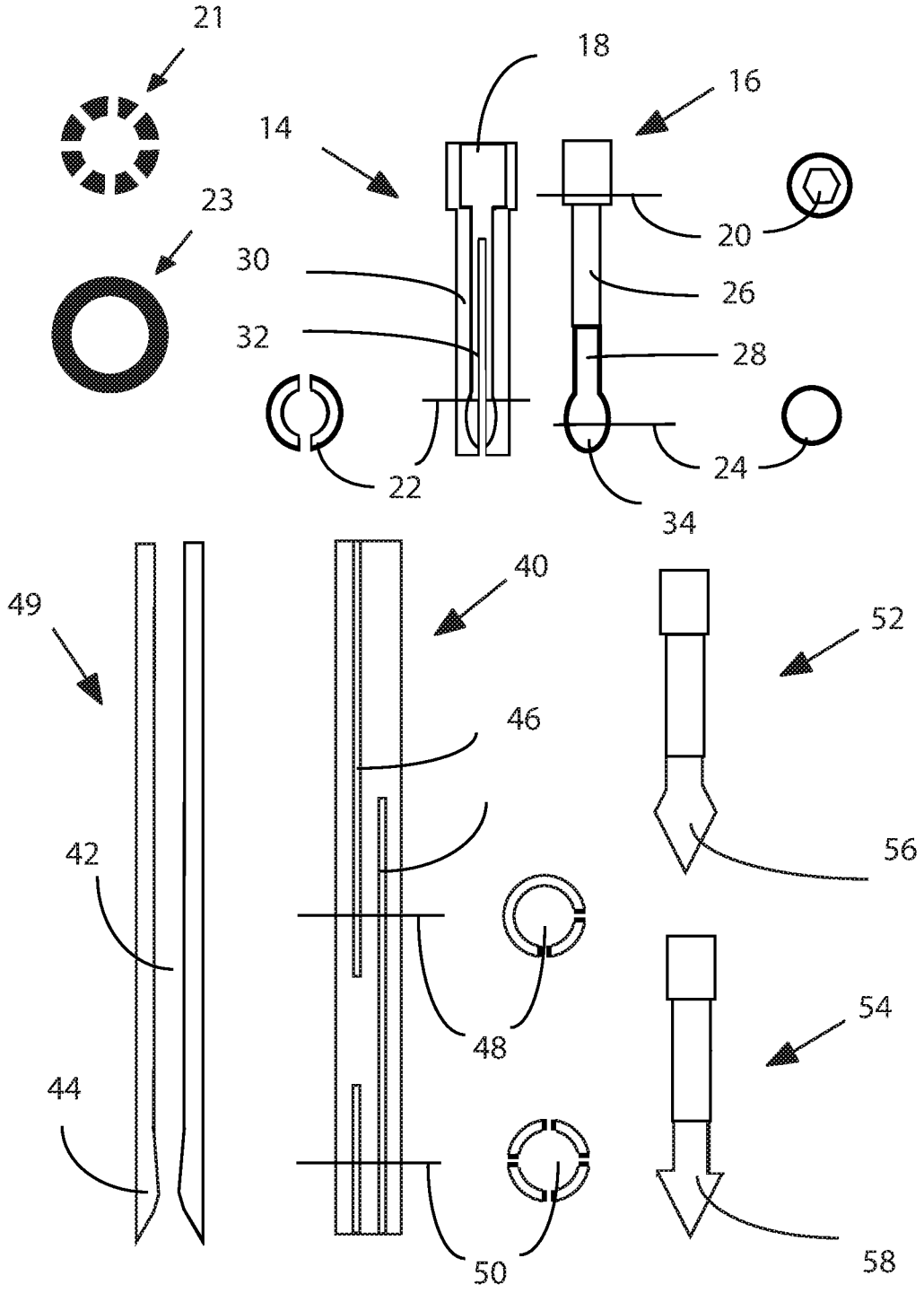

FIG. 2 illustrates cross section and isometric views of this invention.

Figure 3:
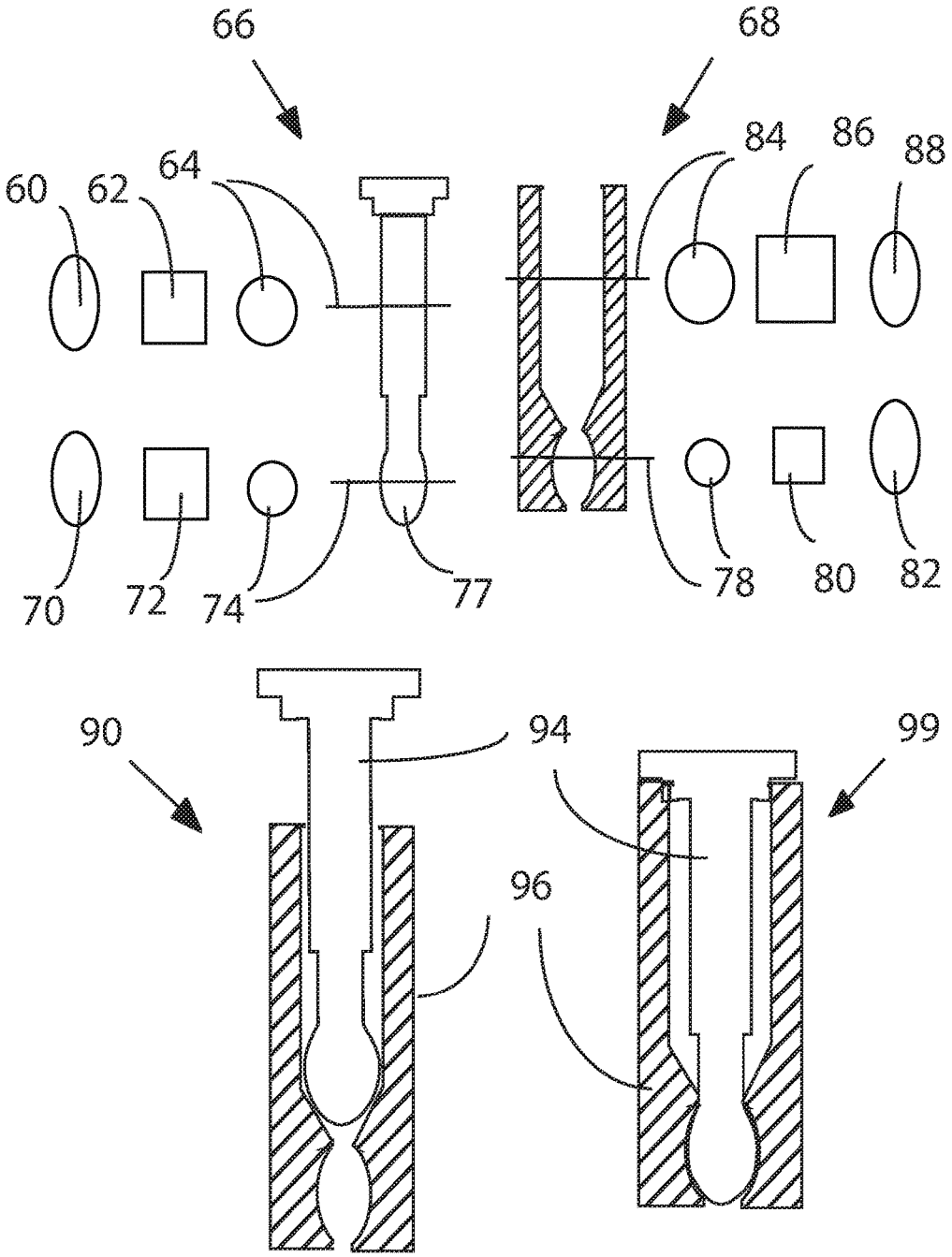

FIG. 3 illustrates cross section views of this invention.

Figure 4:
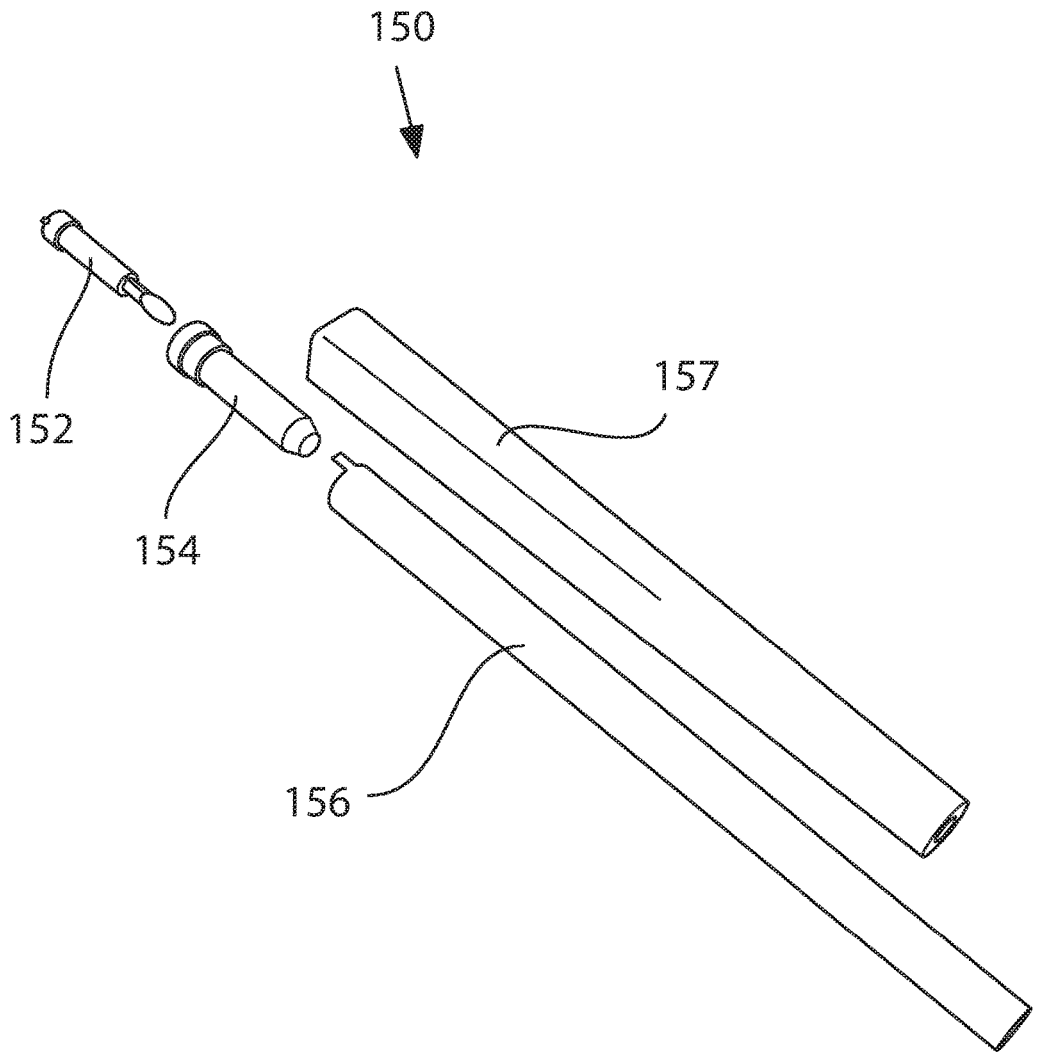

FIG. 4 illustrates isometric view of an alternative compression unit and grip components of this invention.

Figure 5:
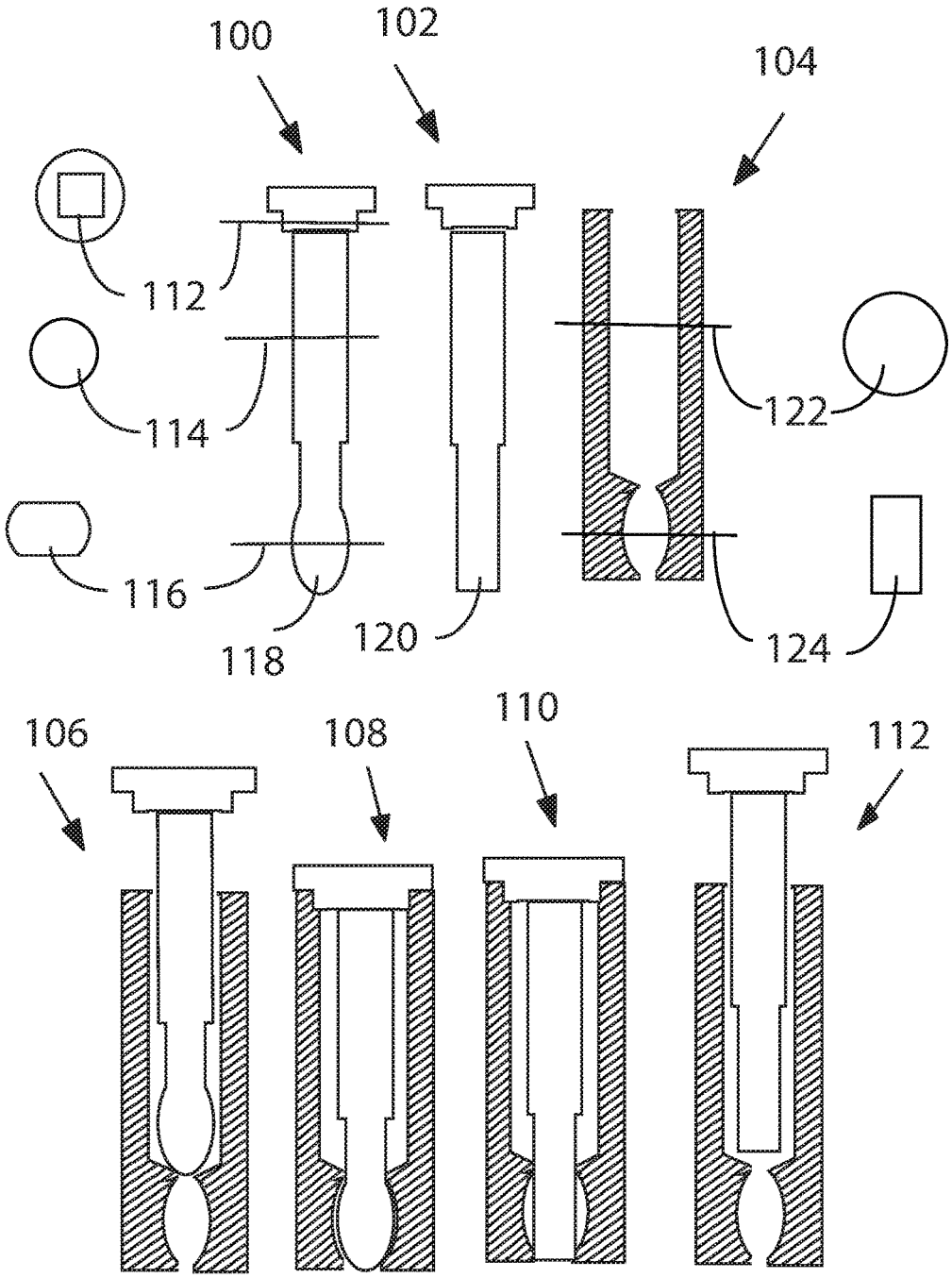

FIG. 5 illustrates cross section views of an alternative compression unit of this invention.

Figure 6:
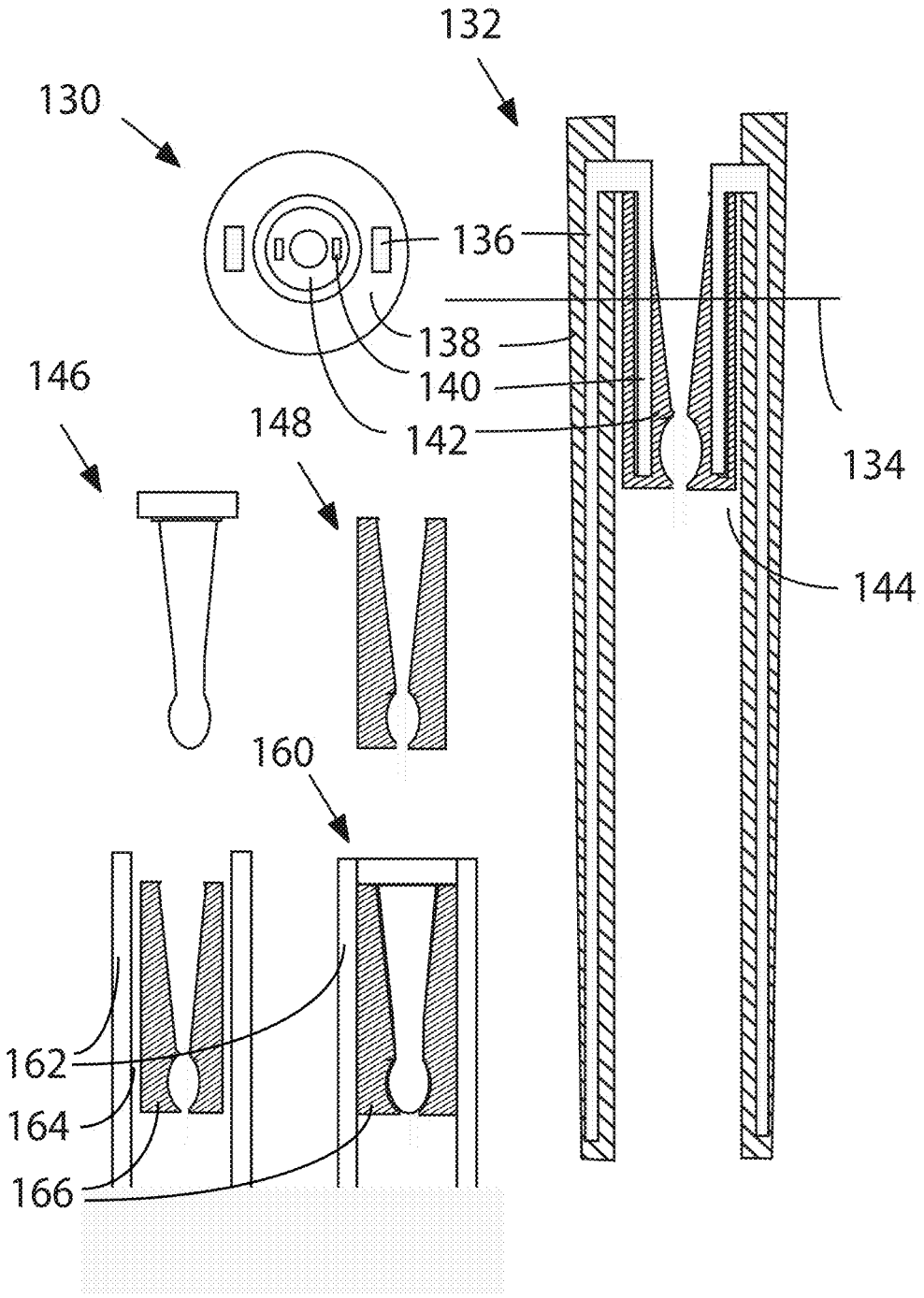

FIG. 6 illustrates cross sections views of an alternative compression unit of this invention.

Figure 7:
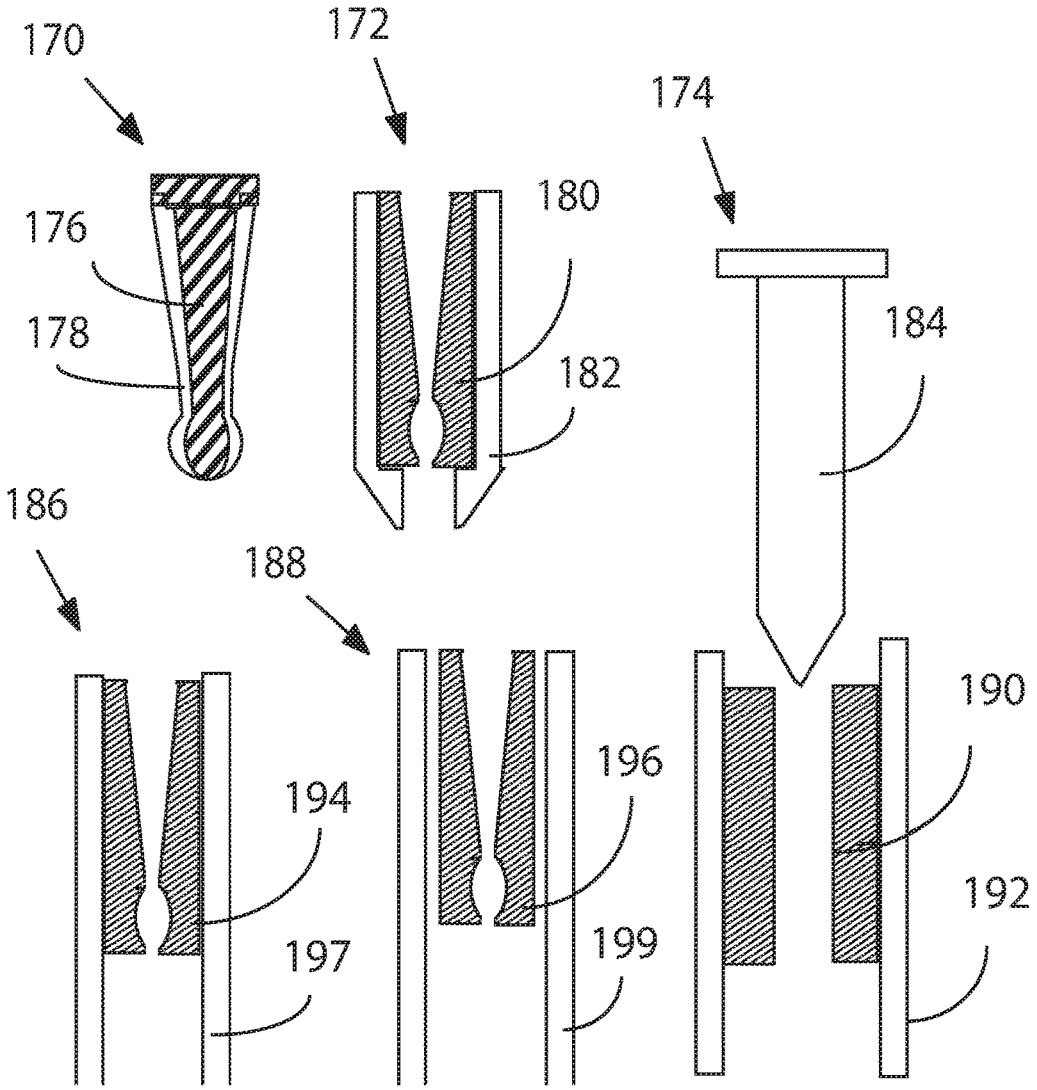

FIG. 7 illustrates cross section views of an alternative of this invention.

Figure 8:
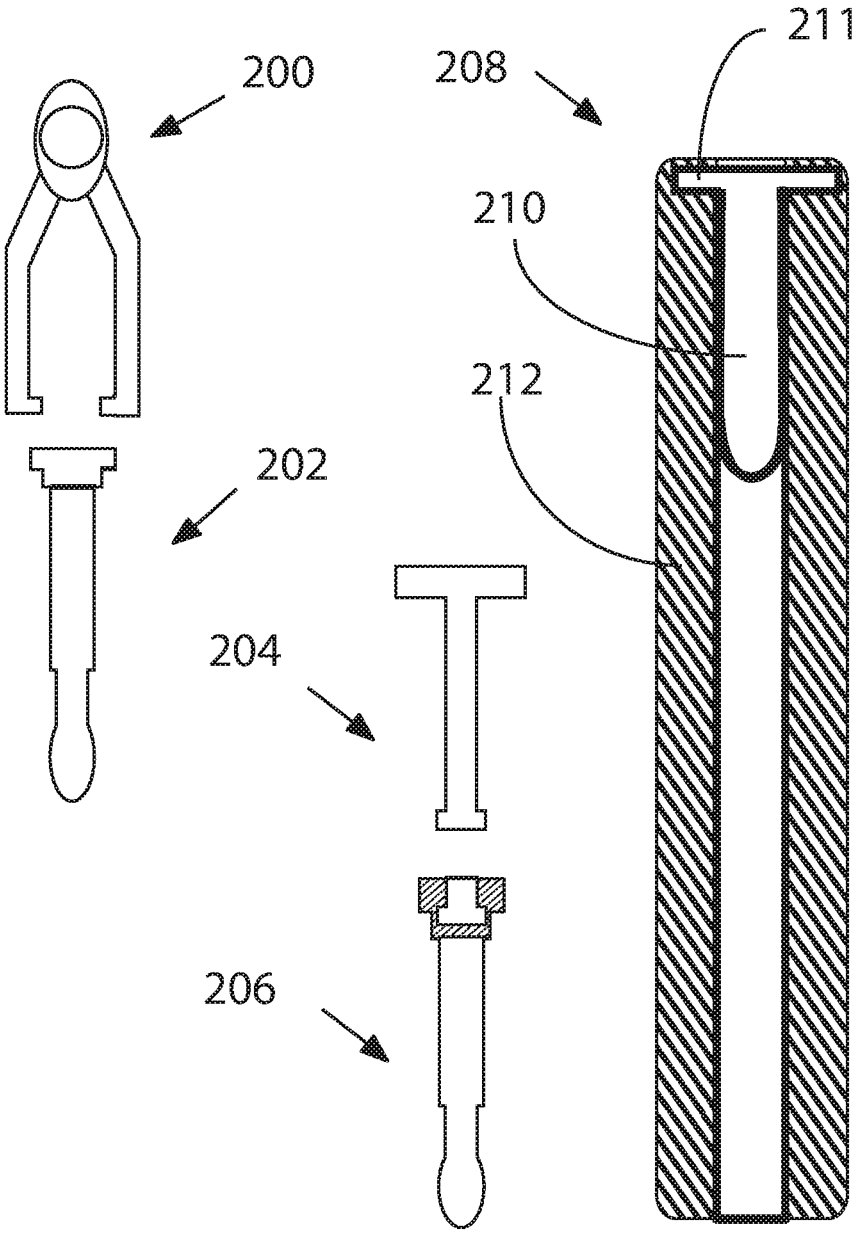

FIG. 8 illustrates an isometric and cross section view of alternative components of this invention.

Figure 9:
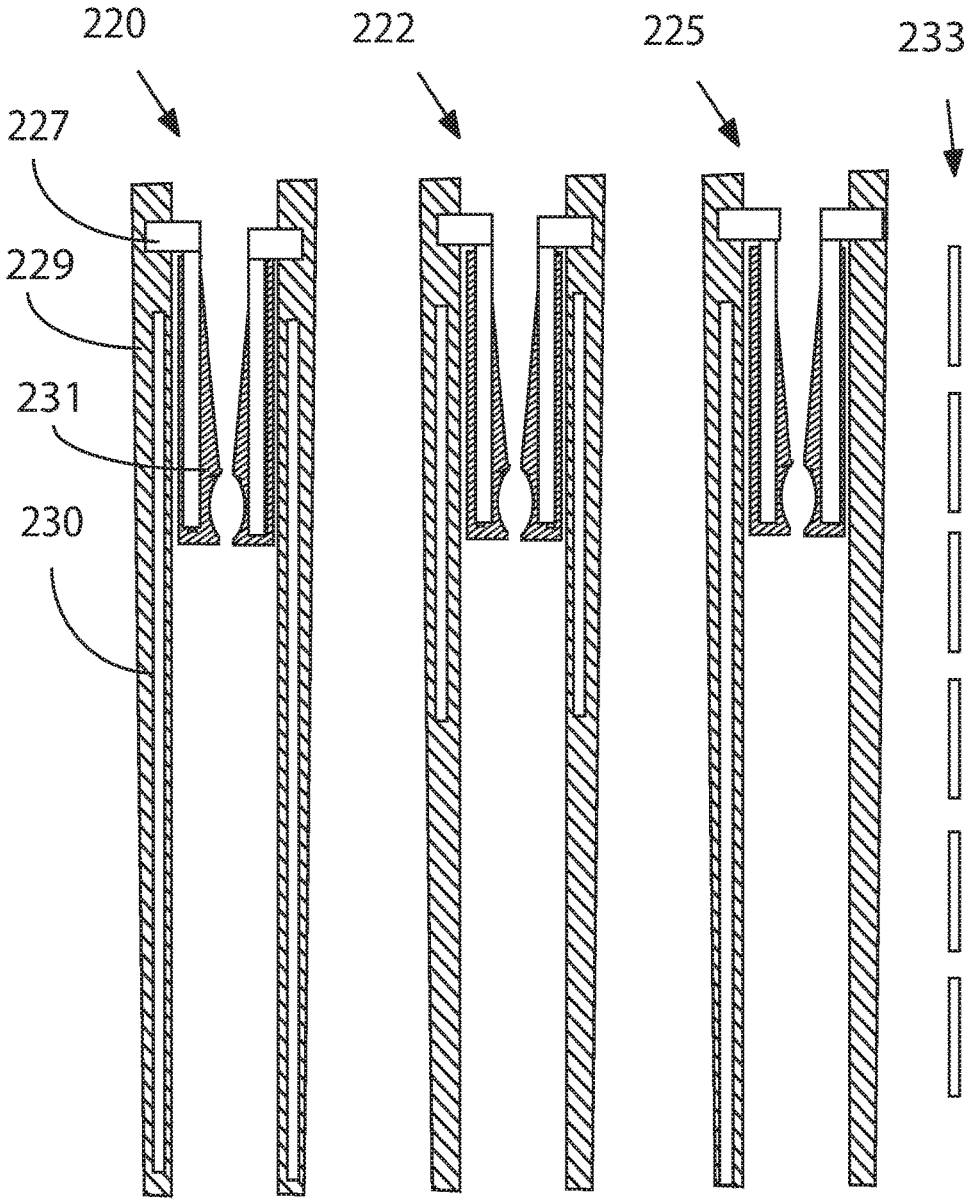

FIG. 9 illustrates cross section views of various support core structures of this invention.

Figure 10:
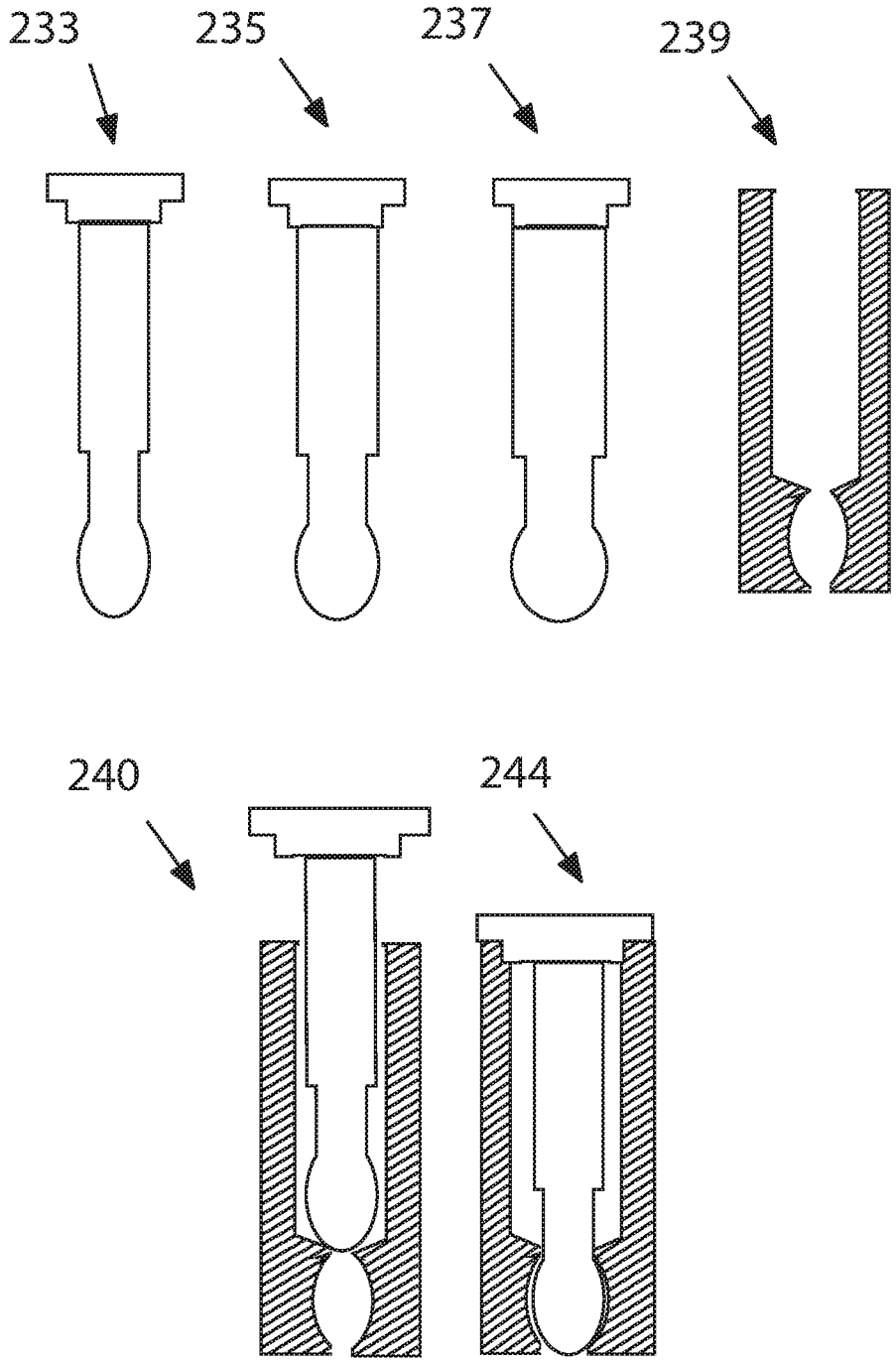

FIG. 10 illustrates a cross section view of various size key and compression units of this invention.

DETAILED DESCRIPTION OF THE PREFERRED EMBODIMENTS

Referring to FIG. 1, golf grip 4 is compression grip 2 mounted on golf club shaft 12. Compression unit 6 enters shaft 12 through the opening at the end. Inner core 10 and outer rubber 8 go over the outside of shaft 12. Inner core 10 is constructed with slots or splits allowing it to expand over various shapes and diameters of a shaft. Putter shafts are parallel for the first 5 to 6 inches. They either taper or decrease in size by steps beyond the parallel section. For a grip to fit tight at the lowest point which is part way down the shaft, it must expand over the top parallel segment and then fit securely onto the lower part of the shaft. Outer rubber 8 allows continuous pressure onto inner core 10 for a tight fit and resistance to movement. The grip is constructed slightly smaller in diameter than the shaft to provide constant compression when seated.

In an alternative form of this invention, no core is required. A grip is constructed of a material and diameter that allows it to slide onto a golf club shaft. The grip is solid enough to minimize twisting and movement. In the preferred embodiment, the grip provides constant compression on to a shaft. Compression unit 6 is joined to the grip and supplies compression inside the golf shaft that is transferred to grip 4.

Referring to FIG. 2, a compression unit that is joined to a golf grip enters into the open end of a golf club shaft. The compression unit of this invention consists of compression component 14 and key component 16. Compression component 14 has lower segment 30 which is split by through slot 32 allowing expansion. There is a central hole running through the center of compression component 14 from top to bottom. The central hole through compression component 14 is shaped with different diameters at different levels.

In cross section 22, a split lower segment results in two legs. Two legs are shown but many more splits may occur with as many as one hundred legs. Cross section 21 shows more legs as a result of more splits. Cross section 23 shows a cross section where no cuts, slots or the like are used. In this case, the outer component is one solid piece of a flexible material such as rubber, silicone, urethanes, plastic or the like. Expansion occurs as a result of material elasticity. The end of this compression unit may be an open hole or closed.

Lower segment 30 expands when inner component 16 is pressed into compression component 14. Inner component 16 referred to as a key enters compression component 14 by placing end 34 into opening 18. There is a hex or other shaped hole in the top of inner component 16. The hole may be square, oval, slot, star shaped or other common shapes for tool engagement. The hole in the top of inner component 16 provides an area of engagement for rotation or to pull the key out of the compression unit. Cross section 20 shows a hex shaped hole that accepts a hex Allen wrench in the upper segment.

Lower segment 28 has a rounded shape as seen in cross section 24. Section 26 is round matching a round segment inside compression component 14. Pressing inner component 16 into compression component 14 expands lower segment 30. The diameter of inner component 16 is the same diameter or less than access hole 18. Inner component 16 strikes a decreased inside diameter of compression component 14 at the bottom section. A projection with ramps inside compression component 14 and in hole 18 presses legs outward onto golf club shaft inner walls (not shown). Legs expand outward when inner component 16 is fully seated in compression component 14.

Cross section 52 and 54 show optional key shapes. Shapes are shown for explanation but are not limited to these. Key component 52 includes straight ramps produced by triangular shape 56 to produce expansion of an outer component with a matching inner shape. Key component 54 includes straight ramps produced by triangular shape 56 to produce expansion of an outer component with a matching inner shape. Flat areas at the top of triangle 58 lock against matching flat areas on the inside of a compression component to lock it in place.

An alternative of this invention, inner core 49, shown in cross section, is an inside full core. Rubber or other common materials are placed over it. The core may be the thickness of a full grip minus the thickness of a thin polyurethane cover to be adhered over it. Thin polyurethane outer layers are commonly used as they provide easy printing of names, colors and patterns. A golf shaft enters into space 42 from the bottom of the core and strikes ramps 44 expanding the grip. As a golf shaft is pressed into core 49, ramps 44 slowly open the grip diameter to allow placement. The inside diameter of core 49 at ramp 44 is significantly less than the upper diameter of a golf shaft. The inner diameter at ramp 44 must press against the shaft when fully placed. The diameter of the shaft decreases as one moves away from the butt end. For example, a golf shaft is 0.580 inches at the top and 0.500 inches or less eleven inches down the shaft.

Isometric view of core 40 shows slots 46. Cross sections 48 and 50 show slot position allowing expansion of a grip during placement. Slots run the full length of the core, part way down or up the core or are intra-core not exiting the ends of the core.

In the preferred embodiment, slots do not run the full length of core 40. In the preferred embodiment, slots overlap in position through the length of the core. The overlapping is accomplished with as few as two slots or as many as one hundred micro slots. Overlapping allows expansion while providing improved rigidity to the core. There may be as few as two splits or as many as one hundred. A core flexes more if a slot or split runs the full length of a core.

When a core is split its full length, the abutting edges slide past each other easily. This allows for easy bending of a grip.

The core of this invention can be designed so the core is in the middle and rubber is at both ends. The frictional properties of rubber onto a golf shaft augment compression and resistance to movement. When the lower end is rubber, it expands over a shaft as it is being placed. When the butt end is rubber, it expands when it is placed onto a shaft. Core structure is positioned between the two ends allowing for reduced friction allowing placement of the grip.

The core structure can be continuous or interrupted. Patches of core material reduce friction. Patches can be individual rings or small islands.

In an alternative version, the core is separated by two full length splits. Overlying rubber allows expansion and helps a grip maintain its position on a shaft. Alternatively, one full length split is used. A cross section would show a C shape.

In an alternative embodiment, the grip has an inner diameter less than the outer diameter of a golf club shaft. A golf grip is always in compression onto the shaft to aid in stability.

A golf grip is constructed at a fix length. Golf club length is changed by cutting off a shaft from the top. Shaft diameter decreases going down. As more shaft material is removed to shorten a golf club, the smaller a golf grip diameter must be to fit properly at its end. Change in grip end diameter requirements is solved by grip expansion. For example, the grip end is 0.500 inches and expands to fit a shaft diameter of 0.510 or 0.520 inches.

The top three to six inches of a golf shaft are parallel and therefore, the same diameter. The actual length of the parallel segment is determined by how much shaft is cut off during golf club length adjustment. For this reason, an alternative embodiment of this grip uses a core with internal parallel sides. Only the end of the grip narrows to a smaller diameter to support the grip. One alternative uses internal protrusions or ramps at the end. Another alternative stops the core short of the end and only rubber touches the shaft. It is possible the core will not touch the shaft for some distance in the middle of the grip. Core and grip materials are stiff enough to accommodate this lack of support from not touching the shaft.

For example, putter shafts are tapered or stepped resulting in a decreased diameter. For this reason, the alternative embodiment of this invention uses a compression fit on the upper parallel segment and a stabilizing compression fit on the opposite end.

In more advanced versions, a compression unit is placed on the distal end opposite the butt end (not shown here). A compression unit provides a method to tighten the grip onto a shaft.

The lower segment of a core can be tapered. A tapered shape may be used outside, inside or both.

Referring to FIG. 3, a cross section view of key 66 has oval end 77. Inner key 66 includes a variety of potential cross sections including 60, 62, 64. 70, 72, and 74. These shapes are just for illustration and other shapes may be used. Compression unit 68, seen in cross section, uses an inside shape matching the outside shape of key 66. A smaller diameter occurs at the bottom. Compression unit 68 may have various cross sections 78, 80, 82, 84, 86 and 88.

View 90 and 99 are seen in cross section. Compression unit 90 shows key 94 positioned into compression unit 96. No compression occurs onto a shaft inner surface at this point. The key is the same or less in diameter than the inside of the compression unit. Key 94 strikes ramps seen as a constricted area on compression component 96 inner hole pressing it outward. Compression unit 96 may have slots for expansion or be a solid flexible material such as rubber.

Cross section view 99 shows key 94 fully seated in compression unit 100. Key 94 presses the compression unit 96 outward. Key 94 engaged ramps inside compression unit 96.

Referring to FIG. 4, an isometric view showing a complete set of components for interchangeable grip 150 is shown including key 152, compression unit 154 with no slots, core 156 and rubber grip 157. When assembled, compression unit 154 is inside and joined to core 156 which is inside and joined to rubber grip 157. Key 152 is free moving and not joined to other components. It is placed inside compression unit 154. It may be encased with material to secure it.

Referring to FIG. 5, the preferred embodiment shown in an isometric view, key 100 has cross section shapes 112, 114 and 116. Key 102 is a side view of key 100 rotated ninety degrees. End 118 of key 100 is rounded producing a cylinder like shape in three dimensions as seen in cross section 116. End 120 of key 102 shows the side view of end 118. Compression unit 104 has cross sections 122 and 124. Inner diameter of compression unit 104 at cross section 124 is less than diameter of key 100 at end 118 as seen in cross section 116. The difference in diameter of these two components causes expansion of the outer compression unit 104 when key 100 is full pressed into position as seen in diagram 106 and 108. The diameter of end 120 of key 102 that is a side view of key 100, is the same or increased diameter of the inner diameter of outer compression unit 104. A flat shape allows key 102 to be removed as no internal ramps of inside surfaces are engaged as seen in diagrams 110 and 112. The key with no change in diameter throughout its lower segment slides past undercuts on opposing surfaces.

Referring to FIG. 6, interchangeable golf grip 132 has rubber 138, core 136 positioned inside rubber 138, compression unit 142, and inner compression support 140 as seen in cross section 134. A golf club shaft is position into space 144 such that compression unit 142 enters inside a shaft while rubber 138 slides along the outside of the shaft.

Core 136 may extend the full length of a rubber grip, it may extend part way, or it may be segmented. The core may extend over the top section of a grip or be separated. The extent of inner core material required will be dictated by the rigidity of grip material.

Key 146 is pressed into compression unit 148. Key 146 is larger than the inside diameter of compression unit 148 so it is forced outward. The compression unit may be passive or active onto shaft walls prior to key placement. In a passive design, shaft 162 does not touch compression unit 166 until a key is fully placed as seen in view 160. Space 164 allows more flexibility to fit into various shaft diameters.

Referring to FIG. 7, key and compression units of this invention may be a solid material or layered with different materials. Key 170 and compression unit 172 use multiple materials. Key 170 has layers 176 and 178. There may be one layer or many layers. Multiple layers are used to control forces, add strength and control compression. Compression unit has inner layer 180 and outer layer 182. Multiple layers are used to control forces, add strength and control compression.

Compression units are placed into a golf shaft prior to placing a key. Compression unit 186 has material 194 which is pressing against shaft walls 197. Compression unit 188 has material 196 which is passive and not touching shaft walls 199. Material 194 is in compression onto shaft 197 to stabilize a grip for a more realistic experience when trying a golf club.

Unit 174 shows trial key 184 placed into compression unit 190. A trial key is easily placed and removed as no undercuts are placed on its surface. Key 184 is placed into compression unit 190 resulting in compression onto the walls of shaft 192. Compression unit 190 is shown with an optional no undercut design. A trial key secures the grip on a temporary, semi-permanent or permanent manner. A trial key makes attaching and removing grips quicker for experience at point of purchase.

Referring to FIG. 8, pliers 200 engage undercuts to remove key 202 when placed into a compression unit. Interlock tool 204 engages internal undercuts to remove key 206 from a compression unit.

Grip 208 has large walls that provide stability and minimize flexing so a core is not required. Compression unit 210 is used without a core structure. Compression unit 210 may have added retention features such as wings 211 to stabilize it within grip 212. Compression unit 210 may be tight against the internal surface of grip rubber 212 or have space.

Referring to FIG. 9, various support core designs are shown. Golf grip 220 has core 227 that extends into a compression unit 231 and grip 229. Side core 230 is detached from core 227 allowing greater expansion when placed onto larger shafts. Golf grip 222 shows the side core structure extending part way down the grip. Golf grip 225 shows side core structure only on one side. Core 233 shows segments structure which is shaped as rods or cylinders within rubber material or with the inside of a grip.

Referring to FIG. 10, different size keys 233, 235, and 237 are used for different sized shafts. When different sized keys are placed inside compression unit 239 as seen in view 240 and 244, it will expand different amounts. Shafts come in many different sizes. For example, 0.580 inches, 0.600 inches and 0.620 inches are commonly used for putters. The inside diameter of each shaft varies in size as well so using different size keys may be required for certain designs and materials used.

Core structures may also vary in size to match a shaft size or materials and design accommodate different diameters.

What I claim is:

1. An interchangeable golf grip system for use with a golf club that is adapted to be removably attached to the upper portion of a golf club shaft, said system comprising:

a golf grip having a top end and an open bottom end, said grip defining a shaft receiving inner chamber;

a compression unit inside the receiving inner chamber of said grip at a top portion of said grip, said compression unit fits into said golf club shaft, said compression unit has an open top end and a bottom end, said top end of said compression unit having a receiving chamber for a key structure, said receiving chamber has a ramp at a bottom portion such that the transverse width of the chamber decreases and then increases in a direction towards said bottom end of said compression unit; and a key structure having a top section and a bottom section, an outer surface of the lower section is of a larger dimension than a dimension of the compression unit receiving chamber, in a first orientation the lower section of said key structure increases in width and then decreases in width in the direction from a top section to a bottom section of said key structure; in a first orientation of said key structure as said key structure is inserted into the said receiving chamber of the compression unit and as the increased width of the lower section of said key structure passes the ramp of said compression unit, the ramp acts as a snap causing the compression unit to engage and hold said key structure, wherein as said key structure is fully inserted into said compression unit receiving chamber the outer surface of the compression unit will have expanded until it contacted an inner wall of said shaft and compressed said compression unit securing said compression unit to said shaft, and wherein said grip is either directly or indirectly attached to said compression unit.

2. The interchangeable golf grip system according to claim 1, wherein the grip is attached directly to the compression unit.

3. The interchangeable golf grip system according to claim 1, wherein a separate core structure lines the receiving chamber of said golf grip.

4. The interchangeable golf grip system according to claim 1, wherein a separate core structure lines the receiving chamber of said golf grip and is attached to said grip and said core structure is attached directly to the compression unit making the grip indirectly attached to said compression unit.

5. The interchangeable golf grip system according to claim 1, wherein a separate core structure is embedded into said golf grip.

6. The interchangeable golf grip system according to claim 1, wherein there are a plurality of grips able to be interchanged.

7. The interchangeable golf grip system according to claim 1, wherein said key structure in said bottom section in said first orientation has a variable width and in a second orientation has a constant width producing flat surfaces.

8. The interchangeable golf grip system according to claim 1, wherein the compression unit has at least one slot in said bottom end.

9. The interchangeable golf grip system according to claim 1, wherein the compression unit has multiple slots in said bottom end.

10. The interchangeable golf grip system according to claim 1, wherein the compression has no slots in said bottom end.

11. The interchangeable golf grip system according to claim 1, wherein the compression comprises a plurality of layers.

* * * * *